US009567789B2

(12) United States Patent
Crown

(10) Patent No.: US 9,567,789 B2
(45) Date of Patent: Feb. 14, 2017

(54) HYDRAULICALLY OPERATED OVERHEAD TILT-UP DOOR

(71) Applicant: Phillip A. Crown, Lester Prairie, MN (US)

(72) Inventor: Phillip A. Crown, Lester Prairie, MN (US)

( * ) Notice: Subject to any disclaimer, the term of this patent is extended or adjusted under 35 U.S.C. 154(b) by 0 days.

(21) Appl. No.: 14/675,225

(22) Filed: Mar. 31, 2015

(65) Prior Publication Data

US 2015/0376928 A1 Dec. 31, 2015

Related U.S. Application Data

(60) Provisional application No. 62/016,951, filed on Jun. 25, 2014.

(51) Int. Cl.

| | |
|---|---|
| ***E05F 15/53*** | (2015.01) |
| ***E05D 15/38*** | (2006.01) |
| ***E06B 3/50*** | (2006.01) |

(52) U.S. Cl.

CPC ..... *E05F 15/53* (2015.01); *E05D 15/38* (2013.01); *E06B 3/5018* (2013.01)

(58) Field of Classification Search

CPC ..... E06B 3/38; E06B 3/5018; E06B 3/5009; E06B 3/52; E05F 15/03; E05D 15/38; Y10S 292/36

USPC ..... 49/197, 199, 201, 202, 203, 204, 205; 292/259 R

See application file for complete search history.

(56) References Cited

U.S. PATENT DOCUMENTS

| | | | | | |
|---|---|---|---|---|---|
| 663,989 | A | * | 12/1900 | Wilson | E05D 15/38 49/197 |
| 1,202,068 | A | * | 10/1916 | Juruick | E06B 3/52 16/310 |
| 1,630,553 | A | | 5/1927 | Watson | |
| 1,709,278 | A | | 4/1929 | Officer | |
| 1,843,973 | A | * | 2/1932 | Dickason | E05D 15/445 49/204 |
| 1,970,222 | A | | 8/1934 | Byrne | |
| 1,980,303 | A | | 11/1934 | Thompson | |
| 2,080,693 | A | | 5/1937 | Byrne | |
| 2,080,904 | A | * | 5/1937 | Wanner | E05F 1/02 49/197 |
| 2,163,394 | A | | 6/1939 | Clark | |

(Continued)

FOREIGN PATENT DOCUMENTS

| | | |
|---|---|---|
| CH | 194711 | 12/1937 |
| CH | 341304 | 9/1959 |

(Continued)

*Primary Examiner* — Katherine Mitchell
*Assistant Examiner* — Marcus Menezes
(74) *Attorney, Agent, or Firm* — Glen E. Schumann; Moss & Barnett

(57) ABSTRACT

There present invention relates to a single panel, hydraulically driven door system. The door and hydraulic cylinder are mounted to the door frame so the door and door frame can be easily installed to a building rough opening. From the door closed position, the hydraulic cylinder raises the door slightly to release a locking mechanism, before the door is rotated to its open position. A control arm and guide track guide movement of the door between its open and closed positions. A variable frequency drive controls the speed of the hydraulic cylinder extension and retraction to provide a smooth transition of the door when moving between its open and closed positions.

16 Claims, 7 Drawing Sheets

(56) References Cited

U.S. PATENT DOCUMENTS

| | | | | | |
|---|---|---|---|---|---|
| 2,222,151 | A | | 11/1940 | Morgan | |
| 2,244,642 | A | | 6/1941 | Ferris et al. | |
| 2,260,080 | A | | 10/1941 | Lane | |
| 2,323,106 | A | | 6/1943 | Whiteman | |
| 2,330,006 | A | | 9/1943 | Odenthal | |
| 2,384,659 | A | | 9/1945 | Wait | |
| 2,388,182 | A | | 10/1945 | Redding et al. | |
| 2,531,119 | A | | 11/1950 | Everitt | |
| 2,532,456 | A | | 12/1950 | Merritt | |
| 2,575,201 | A | | 11/1951 | Tillotson | |
| 2,820,239 | A | | 1/1958 | Johannsen | |
| 3,346,238 | A | | 10/1967 | Dashio | |
| 3,348,336 | A | | 10/1967 | Hashagen | |
| 3,468,060 | A | | 9/1969 | Mursinna | |
| 3,913,266 | A | | 10/1975 | Smith | |
| 4,417,418 | A | * | 11/1983 | Warning | E05F 15/59 160/188 |
| 4,727,792 | A | | 3/1988 | Haussler | |
| 4,765,093 | A | | 8/1988 | Edwards, Jr. | |
| 4,819,376 | A | | 4/1989 | Taddei | |
| 4,941,320 | A | | 7/1990 | Kersten et al. | |
| 5,036,899 | A | | 8/1991 | Mullet | |
| 5,239,776 | A | * | 8/1993 | Lhotak | E05F 15/668 49/199 |
| 5,373,663 | A | * | 12/1994 | Turini | E05D 13/145 49/200 |
| 5,711,113 | A | * | 1/1998 | Nygård | E05D 15/401 49/205 |
| 6,076,589 | A | | 6/2000 | Hormann | |
| 6,883,273 | B2 | * | 4/2005 | Kerkvliet | E05D 11/00 49/199 |
| 7,219,711 | B2 | | 5/2007 | Keller et al. | |
| D584,831 | S | | 1/2009 | Parker | |
| 8,245,446 | B2 | * | 8/2012 | Betker | E05D 15/38 49/197 |
| 8,539,716 | B2 | | 9/2013 | Betker | |
| 9,273,507 | B2 | * | 3/2016 | Petrat | E05F 15/53 |
| 2002/0029524 | A1 | | 3/2002 | Kerkvliet | |
| 2008/0086947 | A1 | | 4/2008 | Crown | |
| 2010/0257789 | A1 | * | 10/2010 | Meeks | E06B 1/70 49/468 |
| 2010/0319258 | A1 | | 12/2010 | Betker | |
| 2011/0232196 | A1 | | 9/2011 | Robinson | |
| 2012/0272577 | A1 | * | 11/2012 | Betker | E05D 15/38 49/199 |
| 2013/0340345 | A1 | * | 12/2013 | Betker | E05D 15/38 49/199 |
| 2014/0210327 | A1 | * | 7/2014 | Schimansky | E05D 15/38 312/317.1 |

FOREIGN PATENT DOCUMENTS

| | | | | | |
|---|---|---|---|---|---|
| CH | 671430 | | | 8/1989 | |
| DE | 3809235 | | | 9/1989 | |
| DE | 102011109552 | A1 | * | 2/2013 | E05D 15/38 |
| EP | 0074502 | | | 3/1983 | |
| GB | 2074228 | A | * | 10/1981 | E05F 15/684 |
| GB | 2220982 | | | 1/1990 | |
| JP | 5715103 | | | 1/1982 | |
| JP | 2003138836 | | | 5/2003 | |

* cited by examiner

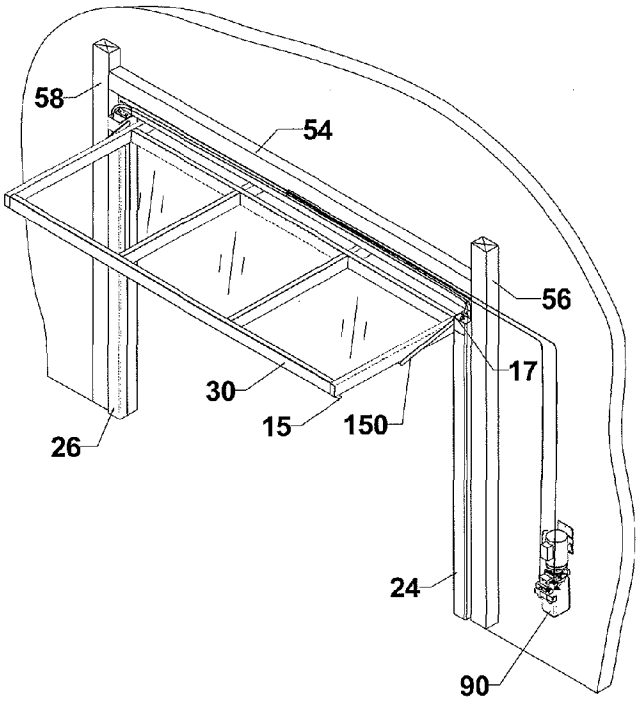
FIG. 5C
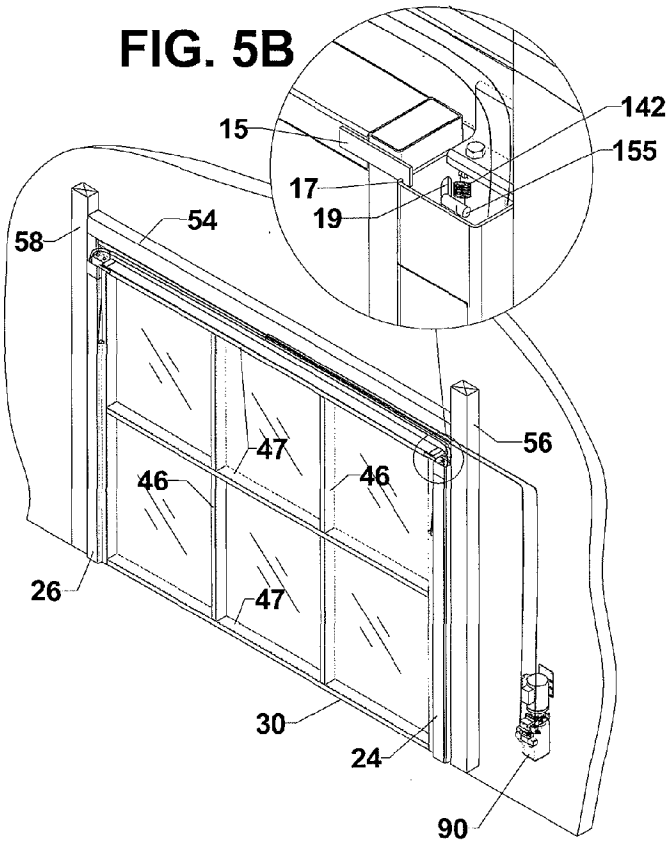
FIG. 5B
FIG. 5A

HYDRAULICALLY OPERATED OVERHEAD TILT-UP DOOR

CROSS-REFERENCE TO RELATED APPLICATION

This utility patent application claims the benefit of U.S. Provisional Application Ser. No. 62/016,951, filed on Jun. 25, 2014 which is incorporated herein in its entirety by reference.

FIELD OF THE INVENTION

The present invention relates to a hydraulically operated overhead tilt up door or window for use with residential, retail, commercial or industrial structures.

BACKGROUND OF THE INVENTION

Many buildings require large access openings to permit the ingress and egress of large equipment, merchandise or flow of people into and from the structure. Covering these large openings requires large doors or windows (hereinafter collectively "doors"). Different types of doors have been developed to cover such openings, such as top or bottom slidably mounted doors supported by a roller/track system, vertically hinged doors, top hinged (overhead) doors, tilt-up doors (single panel doors hinged at mid-height for rotation about a horizontal axis) and bi-fold doors. Various means exist for actuating the doors between their open and closed positions, including man power, cables, screws or hydraulics.

In situations where there is limited available lateral or forward space from the door opening, use of each of these door types is problematic. For instance, large vertically hinged doors have a large arc of rotation and opening the door may be restricted by nearby obstacles. Similarly, slidably mounted doors require significant lateral extension of the horizontal support track(s) from the door opening to support the door when moved to an open position.

Top horizontally hinged doors are frequently utilized when lateral space to the door opening is limited or non-existent. However, these doors still require significant space in front of the door opening to be opened. Further, because of the distance these doors can extend outwardly when in an open position, these doors are susceptible to wind damage. Such doors frequently require significant structural support because they are heavy and leveraged out front of a building. A great deal of force is typically required to open and close these doors because of the door weight.

A version of a top horizontally hinged door that has reduced susceptibility to wind damage and reduced extension from the building is a bi-fold door. However, the main objection to use of a bi-fold door is the loss of headroom. When the door is in its open position, the bi-fold panels typically remain positioned in the upper part of the door opening, creating a height restriction in the door opening.

An objection to use of a single panel tilt door is the arc of swing at the bottom of the door, as it can intrude significantly into the space in front of the door opening. Additionally, the top edge of a single panel tilt-up door may rotate above the top of the door opening as the door is being opened, requiring a significant header area within the building.

Hydraulic cylinders provide ease of opening and closing single panel tilt-up doors. U.S. Pat. No. 8,539,716 to Betker discloses a single panel tilt-up door that utilizes a special top, lateral track that extends into a building. Rollers mounted on the top of the door are guided along the track when the door is opened. Hydraulic cylinders attached to the top end of the door are used to open and close the door.

There remains a need for an easy to open door system that requires no space lateral of the door opening and only limited space in front of the door opening and header space for the door to open, that absorbs many of the load forces created from opening and closing the door and that requires smaller, less expensive hydraulic cylinders to open and close the door.

BRIEF SUMMARY OF THE INVENTION

The door system of the present invention includes a mounting frame assembly and a tilt-up door pivotally and slidably mounted within the mounting frame assembly. The door system is installed in a door rough opening as an integral unit, simplifying installation. At least one hydraulic cylinder is utilized to actuate the door between its open and closed positions.

The mounting frame assembly includes a top horizontal frame member and first and second vertical members secured on opposite ends of the top horizontal frame member. An optional bottom horizontal frame member can be mounted between the bottom ends of the vertical frame members. Guide tracks are formed in the first and second vertical mounting frame members to guide movement of the door as the door is opened and closed. Also located at the top of each vertical frame member is a slot for rotatably and slidably engaging an end of a control arm. The slot can be vertical, arcuate or angled.

On opposite sides of the tilt-up door, located above the vertical center of gravity of the door, are mounted door pivot axles. The axles extend laterally outward from each side of the door to slidably and pivotally engage the guide tracks.

Mounted within at least one of the guide tracks is a hydraulic cylinder. One end of the hydraulic each cylinder is attached to the mounting frame; an opposite end of the hydraulic cylinder is pivotally attached to a corresponding door pivot axle. (In one preferred embodiment, the door system includes two hydraulic cylinders, one mounted in each of the vertical mounting frame members as described supra.) A hydraulic manifold is in fluid communication with the hydraulic cylinder(s) to move the cylinders between extended and retracted positions to open and close the door.

At least one control arm is pivotally attached at a first end to the door to a first side edge of the door. A second end of the control arm is pivotally and slidably secured within the slot defined at the top of a corresponding adjoining vertical door frame member. The control arm guides the door when it is moved between its open and closed positions. In one preferred embodiment, control arms are mounted on each side of the door between the door side edges and the corresponding adjoining vertical door frame members.

A lock tab is mounted on the door and is designed to engage a notch defined in the horizontal frame member of the mounting frame when the door is in its closed position to keep the door secured in place. When the hydraulic cylinders are extended, the door will initially rise vertically for a short distance, guided by the guide tracks, causing the door lock tab to disengage the notch formed in the vertical door frame member. As the hydraulic cylinders are further extended, the top of the door rotates into the building guided by the control arms. The top of the door remains below the level of the top of the building rough opening during opening and closing of the door. When the hydraulic cylinder is retracted, the door rotates back to the door closed position and the lock tab reengages the notch on the mounting frame to prevent the door from tilting back into the building.

The self-framed door system of the present invention is easy to install in a rough opening. Further, because the hydraulic cylinders are secured to the mounting frame and not the building, the load forces created from opening and closing the door are better distributed throughout the mounting frame, resulting in less wear and tear on the building.

The above summary of the invention is not intended to describe each and every embodiment of the invention. The Figures in the detailed description that follow more particularly exemplify these embodiments.

BRIEF DESCRIPTION OF THE DRAWINGS

The invention will be better understood when consideration is given to the following detailed description thereof. Such description makes reference to the annexed drawings wherein:

FIG. 5A is a perspective view of a side of the door assembly of the present invention that faces into a building, with the door in its closed position;

FIG. 5B is an exploded view of a portion of FIG. 5A; and

FIG. 5C is a perspective view of a side of the door assembly of the present invention that faces to the inside of a building, with the door in its open position.

DESCRIPTION OF EXAMPLE EMBODIMENTS

Although the present disclosure is described in connection with exemplary embodiments, the present disclosure is not intended to be limited to the specific forms set forth herein. Other embodiments not disclosed or directly discussed are also considered to be within the scope and spirit of the invention. It is understood that various omissions and substitutions of equivalents are contemplated as circumstances may suggest or render expedient, but these are intended to cover the application or implementation without departing from the spirit or scope of the claims of the present disclosure. Also, it is to be understood that the phraseology and terminology used herein is for the purpose of description and should not be regarded as limiting.

Figure 1:
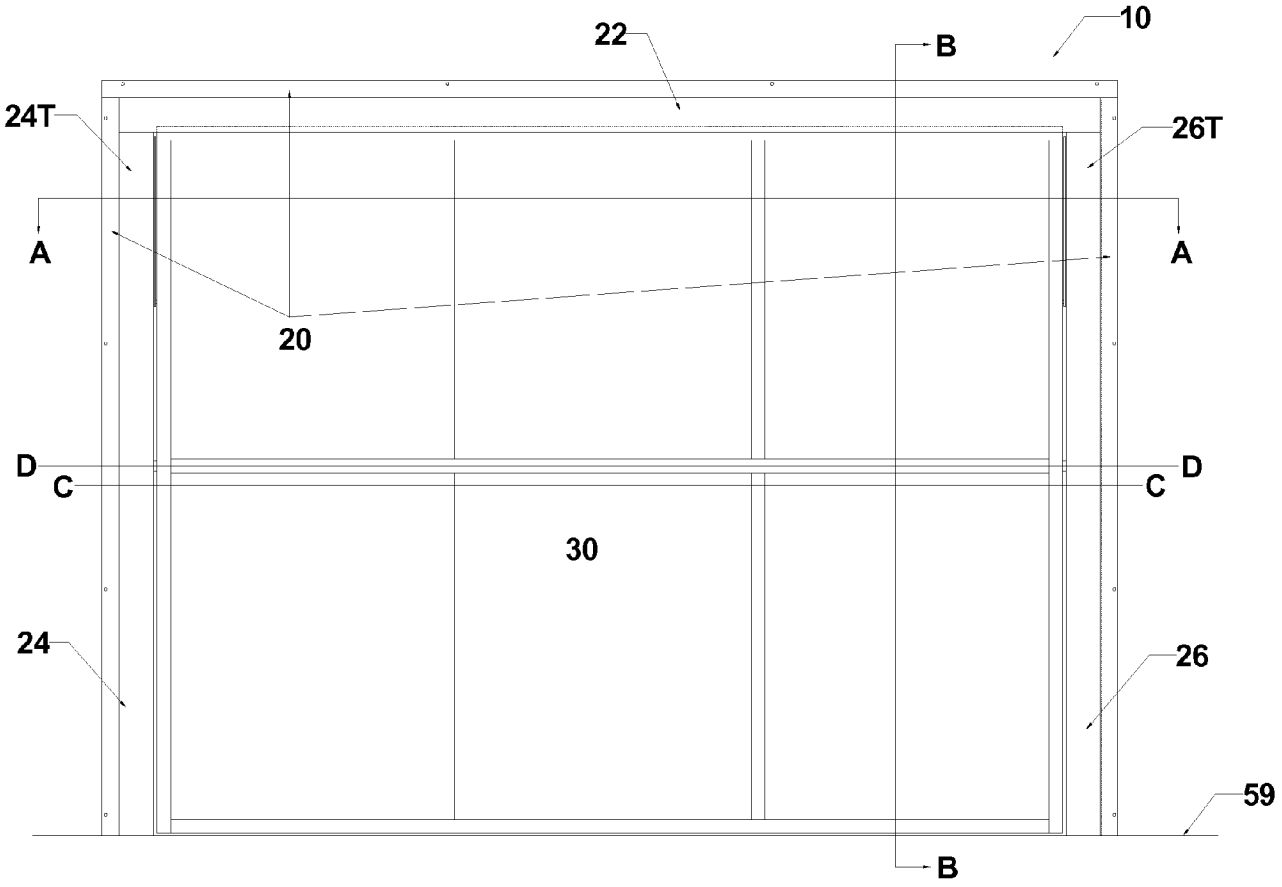
FIG. 1 is a front view of one preferred embodiment of the door assembly of the present invention.

The present invention, as shown at 10 in FIG. 1, is a hydraulically operated overhead tilt up door assembly for an external or internal building door and has application for residential, commercial, industrial or industrial structures. In one preferred embodiment, the hydraulic operated door assembly includes a three-sided mounting frame assembly 20 (with an optional fourth side), a single panel rigid door 30 (illustrated in a typical rectangular shape, although other shapes are anticipated by the present invention) and at least one hydraulic cylinder with a retractable piston (of a type known in the prior art), a screw or other type of actuator 40 for moving the door 30 between an open and closed position. Door 30 may include vertical support members 46 and horizontal support members 47 for strengthening the door.

The door is preinstalled on the mounting frame assembly. To install the door, the mounting frame assembly 20 is positioned within the building rough opening and secured to upper and side door jambs and with the optional fourth side, the building floor.

For exemplary purposes only, and not by way of limitation, the door assembly 10 will be described using two hydraulic cylinders, even though the door system can be operated with a single hydraulic cylinder. Further, other components and features, such as alarms, sensors, windows and doors-within-a-door can also be used with the invention and should be considered to be within the spirit and scope of the invention.

Referring to FIG. 1, the complete mounting frame assembly 20 includes a top horizontal frame member 22 and first and second vertical frame members 24 and 26. A top end 24T of first vertical frame member 24 is secured to a first end of the top horizontal frame member 22 and a top end 26T of second vertical frame member 26 is secured to a second end of the horizontal frame member, opposite the first end of the horizontal frame member.

Figure 4B:
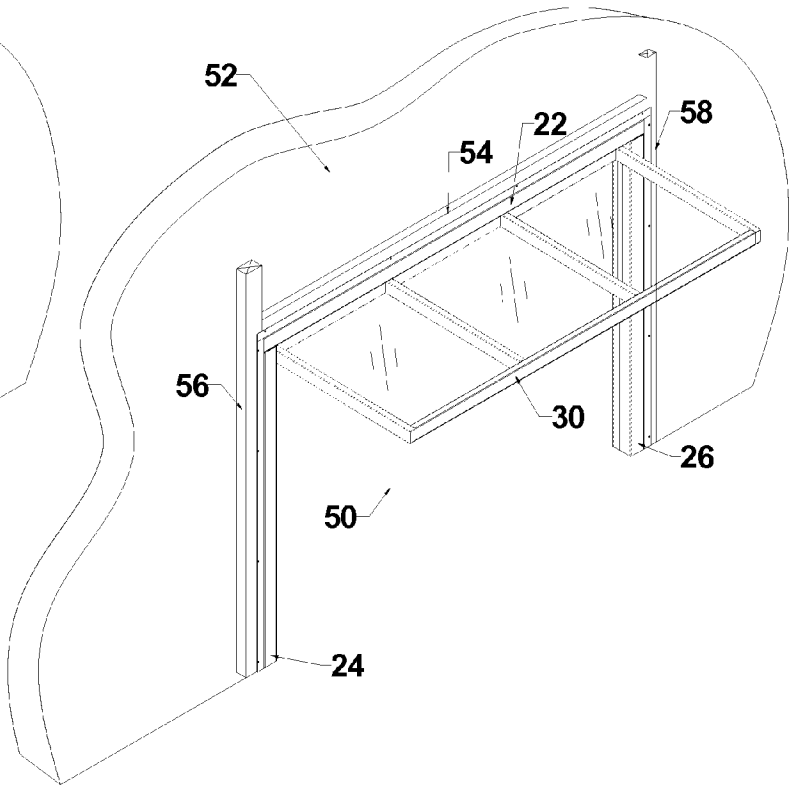
FIG. 4B is a perspective view of a side of the door assembly of the present invention that faces to the outside of a building, with the door in its open position.
Figure 4A:
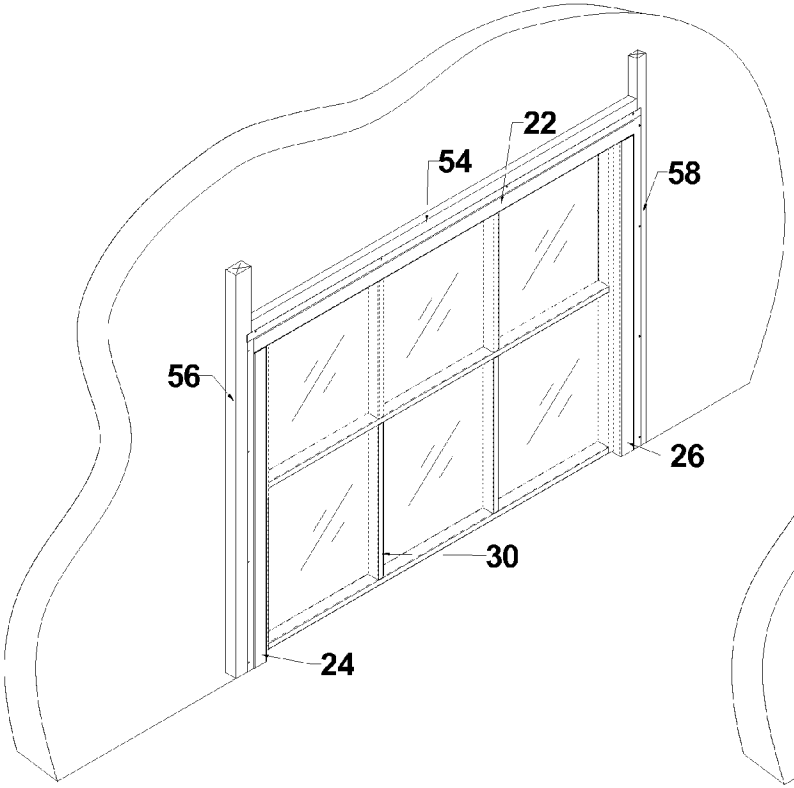
FIG. 4A is a perspective view of a side of the door assembly of the present invention that faces to the outside of a building, with the door in its closed position.

When installed in a rough opening 50 of a building or structure 52, as shown in FIG. 4B, the top horizontal frame member 22 is secured to a top member of the rough opening 50 of the building. The first and second vertical frame members 24 and 26 are secured to rough opening side jambs 56 and 58, respectively. An optional bottom horizontal member 45 may be secured at a first end to the bottom end of the first vertical frame member 24 and at a second end to the bottom end of the second vertical frame member 26 and to a floor 59 of the building 52 (3C).

One skilled in the art will understand that the complete mounting frame 20 can be secured to the structure or ground by numerous techniques and devices such that those suggested herein which should not be considered limiting. One skilled in the art will also appreciate that the mounting frame 20 can be made from any type of material including steel plating that is either welded together or coupled together with any type of fastener known in the prior art. The mounting frame or door support 20 can also be manufactured from other light, generally rigid, materials such as aluminum or other composite materials.

While the horizontal and vertical mounting frame mounting members serve a structural purpose, as discussed infra, the vertical mounting frame members also house the door track guides, hydraulic cylinder and cylinder hoses to create a very clean appearance and few exposed moving parts.

Door panel axle vertical guides 60 are located in vertical frame members 24 and 26 and guide movement of the door between its opened and closed positions. On opposite side edges 31 and 32 of door 30, located above the vertical center of gravity of the door, pivot axles 38 extend laterally outward from each side of the door to pivotally and slidably engage door panel axle vertical guides 60. Axles 38 are mounted to keep the upper and lower portions of the door as balanced as possible, but with the lower portion (below the center of gravity of the door) slightly heavier than the top portion of the door. In one preferred embodiment, the axles may be located anywhere from zero to 24 inches above the vertical (weight) centerline C-C of the door 30. In another preferred embodiment, the axles 38 are positioned within two inches above the vertical (weight) centerline C-C of the door 30 to keep the door as balanced as possible.

The axles 38 define a pivot axis D-D for the door. The axles 38 are positioned to keep the bottom end of the door 30 (below the horizontal pivot axis D-D) heavier than the portion of the door 30 above pivot axis D-D to prevent the door panel 30 from tipping back and forth when being raised or closed.

Also mounted within each vertical mounting frame member is a hydraulic cylinder. A first end of the hydraulic cylinder includes a clevis 100 which pivotally engages a corresponding door axle. A second end of the hydraulic cylinder is either pivotally or fixedly secured to the bottom of the vertical door frame members. Because the hydraulic cylinders are secured to the mounting frame and not the building, the load forces created from opening and closing the door are better distributed throughout the mounting frame, resulting in less wear and tear on the building structure. (An alternate to a hydraulic cylinder in the present invention could be a screw, electric worm drive, electric actuator or cable system that performs the same function in the same manner.)

A hydraulic power unit drives the hydraulic cylinders. In one preferred embodiment, the hydraulic cylinders will operate on a variable frequency drive (VFD), which involves varying the speed of the motor/pump 90 to vary the speed of the door opening and closing. The speeds implemented are related to the position of the control arm 150. In one preferred embodiment, the door is opened at a slower speed at the point of close and initial opening and is operated at higher speeds throughout the remainder of the travel of the door. Variable speeds create a smoother transition from one position of the door to the next (open to close to open).

By way of illustration, in one preferred embodiment, an 8 foot door is opened in 25-30 seconds. The hydraulic cylinder extends at approximately 2 inches in 4 seconds initially. Thereafter, the speed is increased to approximately double its initial speed until just before full open, when it is again slowed to 2 inches in 4 seconds. The same speeds would happen at the same points when the door is closed.

Figure 1A:
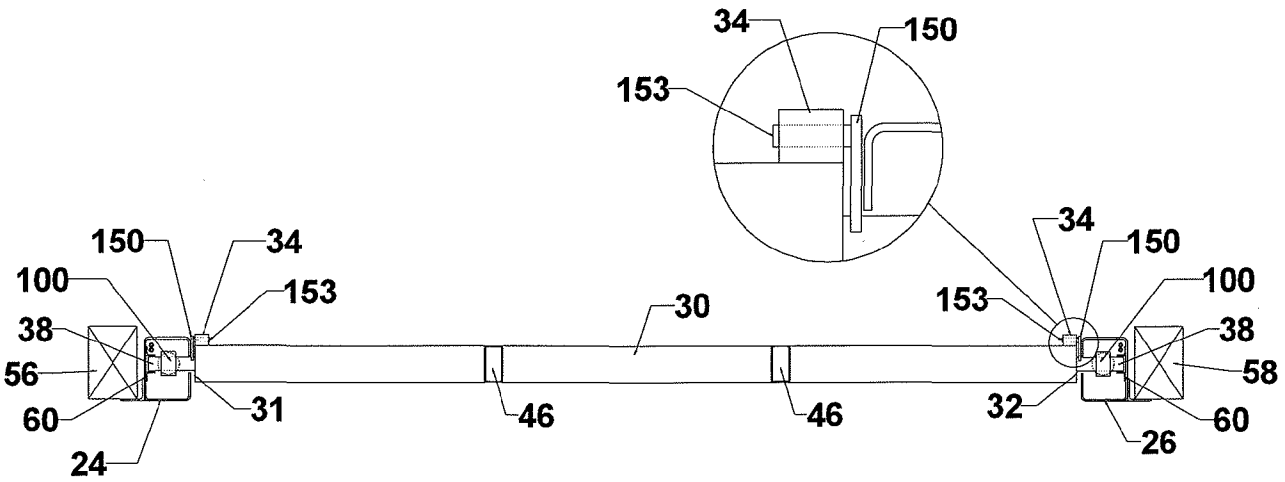
FIG. 1A is a view of FIG. 1 taken along line A-A in FIG. 1.

Also secured to and extending laterally outward from door side edges 31 and 32 (FIG. 1A), anywhere from 12 to 120 inches below the top of door 30, are lower pivot barrels 34. Each pivot barrel 34 is intended to pivotally engage a first end of a control arm 150. The first end of the control arm 150 includes, in one embodiment, a pin 153 for pivotally engaging the pivot barrel, defining a lower pivot axis or control arm 150.

As shown in FIG. 5B, the vertical frame members 24 and 26 include a slot 19 for pivotally and slidably receiving upper pin 155 located at the top end of control arm 150. Upper pin 155 defines an upper pivot axis of the control arm 150. The positioning of the control arm upper pivot axis and lower pivot axis and door axles 38 determines the curvature of rotation of the top of the door as the door is being raised or closed. Proper positioning of the location of the axles 38 and lower and upper pivot axes will prevent the top edge 159 of door 30 from extending above a horizontal plane 162 defined by the bottom of top member 54 of the rough opening 50. Further, the door can open to a near horizontal position.

As shown in FIG. 5B, an optional spring 142 may be utilized to apply upward pressure on the control arm upper pin 155, preventing it from dropping in the slot when the door is in an open or near open orientation.

The present invention eliminates the need for creating headroom above the rough opening to accommodate opening and closing of the door and further minimizes the amount of space taken up in the rough opening by the door when in an open position. Further, the amount of door extending forward of the door opening is minimized, minimizing the effect of wind on the door, which reduces the structure required to support the door.

Figure 1C:
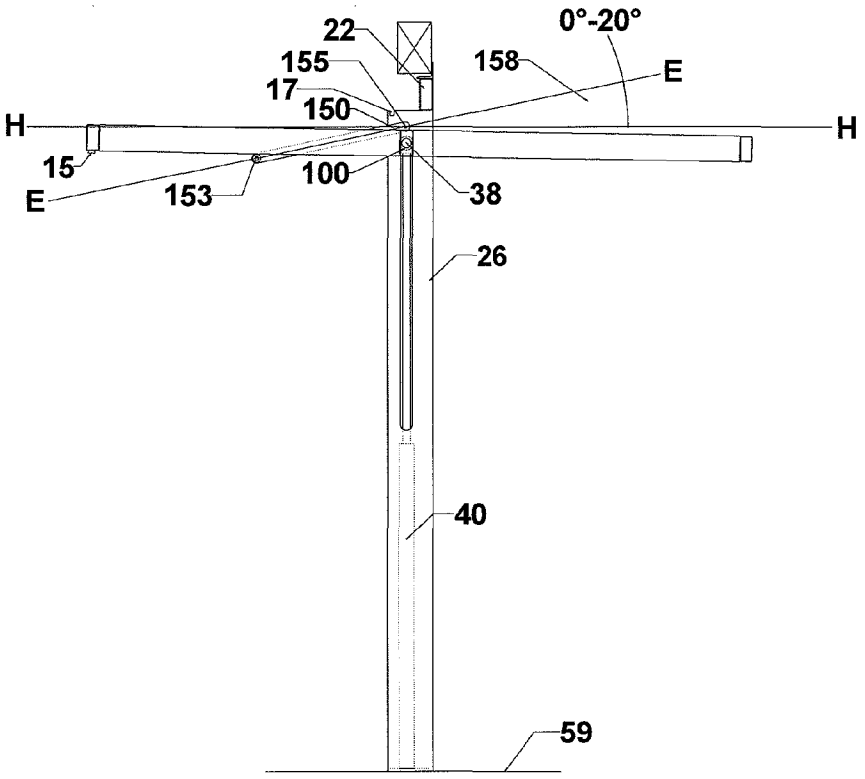
FIG. 1C is a side view of the door assembly of the present invention with the door in its open position.
Figure 1B:
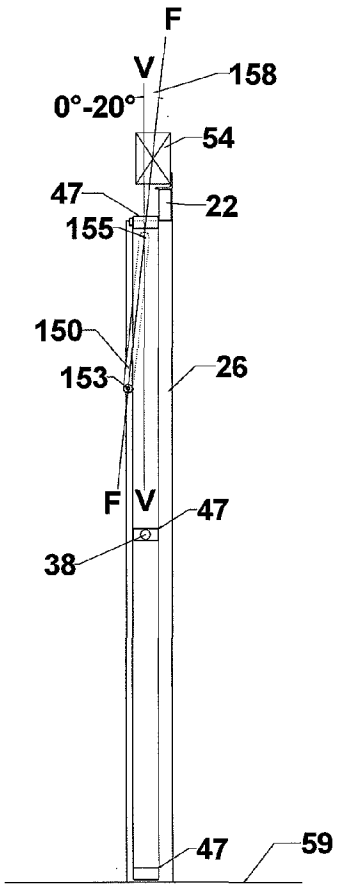
FIG. 1B is a view of FIG. 1 taken along line B-B in FIG. 1.

Referring to FIG. 1B, line V-V is a vertical line running through the control arm upper pivot axis and line F-F is a line extending through the control arm upper pivot axis and lower pivot axis. In one preferred embodiment, the angle 158 formed by these two lines is ideally between 0 and 20 degrees. In another preferred embodiment, the angle is about 6°. At these angles, the door top will not extend above the horizontal plane 162 when being opened or closed.

Referring to FIG. 1C, the line H-H is a horizontal line running through the control arm upper pivot axis and line E-E is a line extending through the control arm upper pivot axis and lower pivot axis. In one preferred embodiment, the angle formed by these two lines H-H and E-E is ideally between 0 and 20 degrees.

Figure 2B:
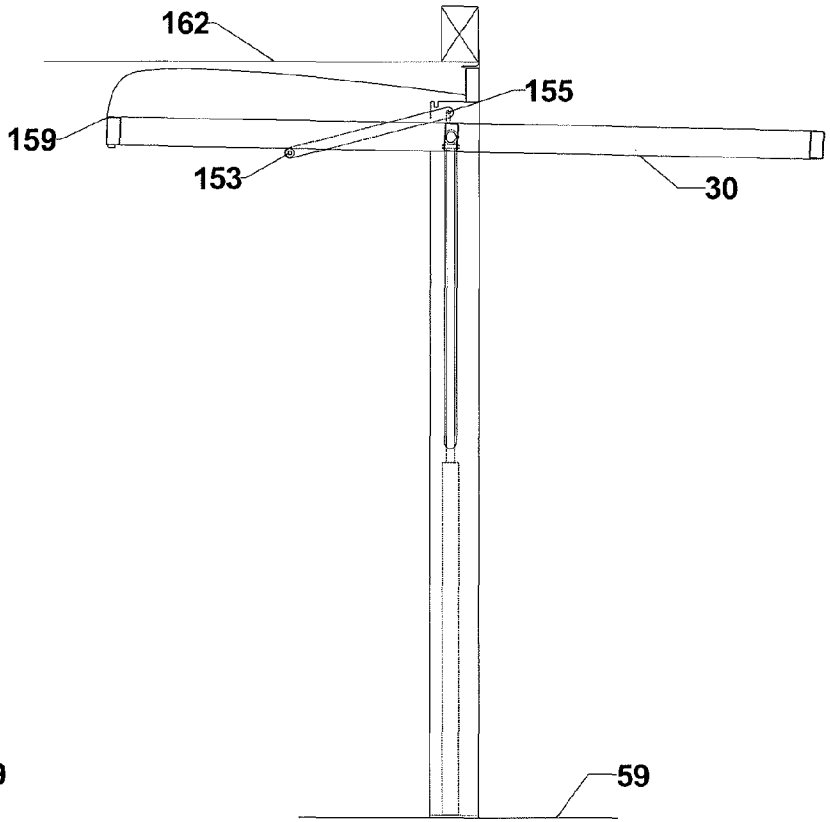
FIG. 2B is a side view of the door assembly of the present invention with the door in its open position.
Figure 2A:
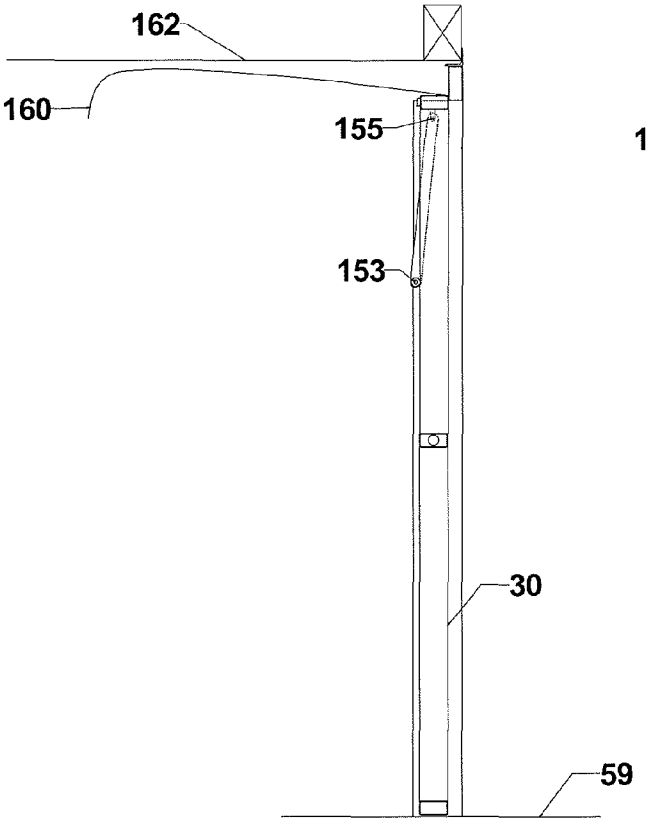
FIG. 2A is a side view of the door assembly of the present invention with the door in its closed position.
Figures 3A, 3B, 3C:
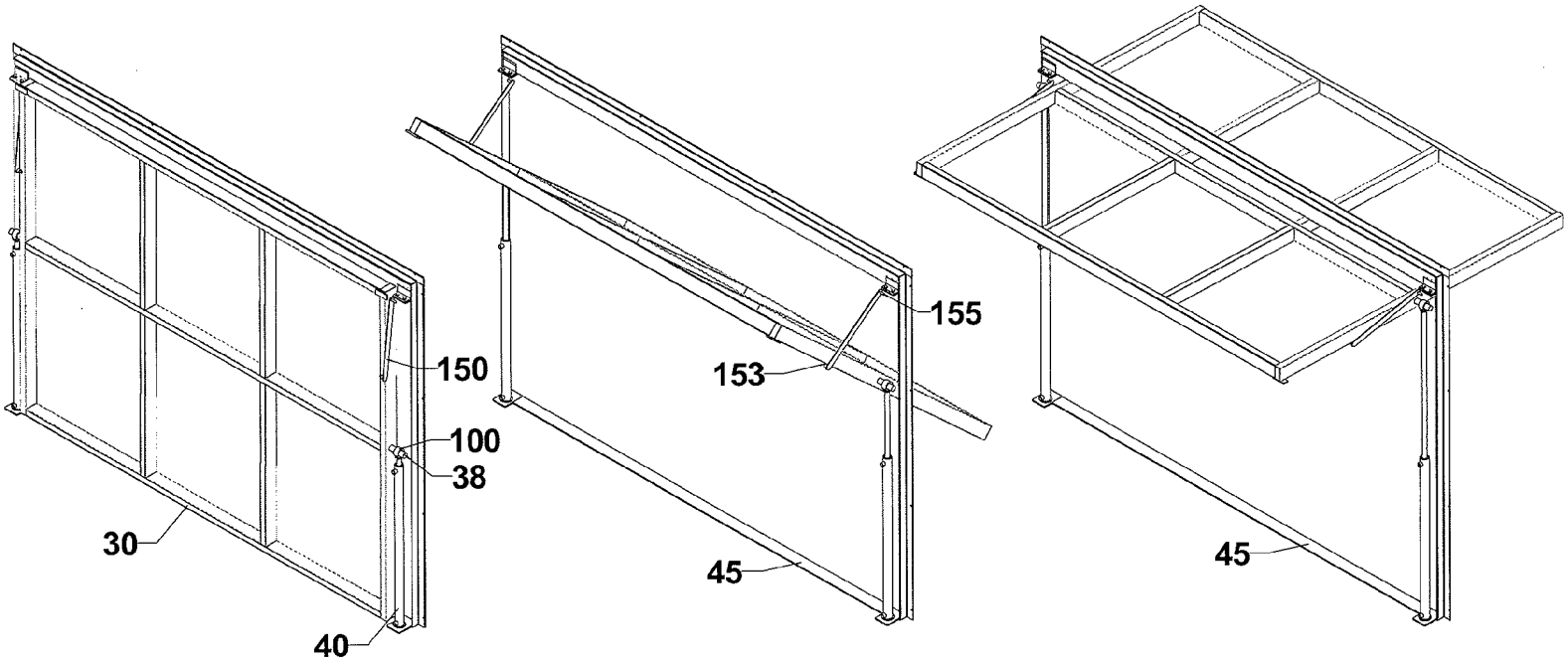
FIG. 3A is a perspective view of a side of the door assembly of the present invention that faces into a building, with the door in its closed position with parts of first and second vertical frame members suppressed for clarity.
FIG. 3B is a perspective view of a side of the door assembly of the present invention that faces into a building, with the door in its partially open position with parts of first and second vertical frame members suppressed for clarity.
FIG. 3C is a perspective view of a side of the door assembly of the present invention that faces into a building, with the door in its open position with parts of first and second vertical frame members suppressed for clarity.

Referring to FIGS. 2A and 2B, the arc defined by the top edge 159 of the door 30, when being opened or closed, is reflected at 160. As illustrated, the top of the door does not break the horizontal plane defined by the bottom of top member 54 of the rough opening 50. FIG. 2B illustrates the position of the door 30 in its open position, substantially horizontal, with the hydraulic cylinder fully extended.

At the top of each vertical mounting frame member is a notch 17 for receiving an upper lock tab 15 secured to the top door panel horizontal member. When the door is in its closed position, as shown in FIG. 5B, lock tab 15 sits within notch 17 to prevent the door 30 from tilting forward or backward due to wind or manual force.

In operation, from a closed position, the door 30 rises vertically ¾ to 1" before starting its inward rotation into the building. This is made possible by the slot 19. The control arm 150 is allowed to move upward for the distance of the slot, before engaging the upper pin 155, which then initiates rotation of the door.

The invention may be embodied in these and other specific forms without departing from the spirit or attributes thereof, and it is therefore desired that the embodiments be considered in all respects as illustrative and not restrictive, reference being made to the appended claims rather than to the foregoing description to indicate the scope of the invention.

What is claimed is:

1. A tilt up door and mounting frame assembly for an opening in a building, comprising:

a mounting frame assembly mountable within the opening of the building, the mounting frame assembly including a top horizontal frame member, a first vertical frame member having a top end and a bottom end and secured by the top end to a first end of the horizontal frame member, a second vertical frame member having a top end and a bottom end and secured by the top end to a second end of the horizontal frame member, door panel axle vertical guides mounted within each vertical frame member, a slot defined in the top end of at least one vertical frame member for pivotally and slidably receiving a pin carried at an upper end of a control arm, and a notch defined at the top end of at least one vertical frame member for receiving a lock tab;

a single panel door having an -upper edge, side edges, a vertical center of gravity, horizontally aligned axles extending laterally from each side edge of the door at or above the vertical center of gravity of the door defining a door pivot axis, each axle pivotally and slidably engaging a corresponding door panel axle vertical guide, and the lock tab secured to the upper edge of the single panel door for engaging the notch defined at the top end of at least one vertical frame member;

the control arm having a lower end with a lower end pivot pin and an upper end with an upper end pivot pin, the control arm lower end pivot pin being pivotally secured to the single panel door and the control arm upper end pivot pin being pivotally and slidably secured within the slot defined in the top end of a vertical frame member;

at least one linearly extendable actuator having an upper end and a lower end, pivotally mounted by the upper end of the linearly extendable actuator to a door axle and secured by the lower end of the linearly extendable actuator to the mounting frame assembly;

a linearly extendable actuator control assembly in communication with the linearly extendable actuator to control extension and retraction of the linearly extendable actuator to open and close the door;

wherein, when the door is moved from a closed position to an open position, the control arm on the mounting frame assembly permits limited vertical movement of the door to release the lock tab from the vertical frame member notch so the door can rotate to its open position, and when the door is moved from its open position to its closed position, the lock tab engages the vertical frame member notch as the door is closed to prevent the door from rotating, wherein at least one vertical frame member has a front face and a rear face, the front face defines a first plane and the rear face defines a second plane, and the slot extends longitudinally between the first plane and the second plane, and wherein when the door is moved from the closed position to the open position, the door rises vertically before starting its inward rotation into the building.

2. The tilt up door and mounting frame assembly of claim 1 wherein the linearly extendable actuator is mounted within a door panel axle vertical guide.

3. The tilt up door and mounting frame assembly of claim 1 wherein the pivot axis defined by the axles are positioned above the vertical center of gravity of the door to keep a portion of the door below the pivot axis heavier than a portion of the door above the pivot axis.

4. The tilt up door and mounting frame assembly of claim 1 wherein the axles are mounted in a range of zero to 24 inches above a vertical center of weight of the door.

5. The tilt up door and mounting frame assembly of claim 1 wherein the axles are mounted approximately two inches above a vertical center of weight of the door.

6. The tilt up door and mounting frame assembly of claim 1 wherein the linearly extendable actuator is a hydraulic cylinder.

7. The tilt up door and mounting frame assembly of claim 1 wherein the linearly extendable actuator operates on a variable frequency drive.

8. The tilt up door and mounting frame assembly of claim 1 wherein the control arm upper and lower end pivot pins define an upper pivot axis and lower pivot axis, respectively, and a horizontal line running through the control arm upper pivot axis and a line extending through the control arm upper and lower pivot axes form an angle of between 0 and 20 degrees when the door is in the open position.

9. The tilt up door and mounting frame assembly of claim 1 wherein the control arm upper and lower end pivot pins define an upper pivot axis and lower pivot axis, respectively, and a vertical line running through the control arm upper pivot axis and a line extending through the control arm upper pivot axis and lower pivot axis form an angle between 0 and 20 degrees when the door is in the open position.

10. The tilt up door and mounting frame assembly of claim 1 wherein the control arm upper and lower end pivot pins define an upper pivot axis and lower pivot axis, respectively, and a vertical line running through the control arm upper pivot axis and a line extending through the control arm upper pivot axis and lower pivot axis form an angle of about 6° when the door is in the closed position.

11. The tilt up door and mounting frame assembly of claim 1 further including a bottom horizontal member rigidly secured at a first end to the bottom end of the first vertical frame member and rigidly secured at a second end to the bottom end of the second vertical frame member.

12. The tilt up door and mounting frame assembly of claim 1 wherein each vertical frame member includes a slot at the top end thereof for slidably and pivotally engaging a first end of a control arm, and wherein the control arm further comprises a pair of control arms, one control arm located on each side edge of the door, and wherein for each control arm, the control arm lower end pivot pin being pivotally secured to a corresponding side edge of the single panel door and the control arm upper end pivot pin being pivotally and slidably secured within a corresponding slot defined in the top end of a vertical frame member.

13. The tilt up door and mounting frame assembly of claim 1 wherein the slot defined in the top end of at least one vertical frame member is linear.

14. The tilt up door and mounting frame assembly of claim 1 wherein the slot defined in the top end of at least one vertical frame member is arcuate.

15. The tilt up door and mounting frame assembly of claim 1 wherein the slot defined in the top end of at least one vertical frame member is oriented at an angle with respect to a vertical axis of at least one vertical frame member.

16. The tilt up door and mounting frame assembly of claim 1 further comprising a spring secured to the control arm upper end pivot pin to apply upward pressure on the control arm, preventing the lock tab from dropping in the slot when the door is in an open or near open orientation.

* * * * *